United States Patent [19]

Hendrickson et al.

[11] Patent Number: 4,600,673

[45] Date of Patent: Jul. 15, 1986

[54] SILICONE RELEASE COATINGS FOR EFFICIENT TONER TRANSFER

[75] Inventors: William A. Hendrickson, New Brighton; Jack L. Evans, St. Paul; Kenneth R. Paulson, North St. Paul; Robert W. Wilson, Falcon Heights, all of Minn.

[73] Assignee: Minnesota Mining and Manufacturing Company, St. Paul, Minn.

[21] Appl. No.: 725,511

[22] Filed: Apr. 22, 1985

Related U.S. Application Data

[63] Continuation of Ser. No. 520,208, Aug. 4, 1983, abandoned.

[51] Int. Cl.[4] ..... G03G 5/14

[52] U.S. Cl. ..... 430/66; 430/67; 430/126

[58] Field of Search ..... 430/66, 67, 126

[56] References Cited

U.S. PATENT DOCUMENTS

| | | | |
|---|---|---|---|
| 3,037,861 | 6/1962 | Hoegl et al. . | |
| 3,061,567 | 10/1962 | Keil . | |
| 3,476,659 | 7/1966 | Sato et al. | 204/18 |
| 3,554,836 | 7/1968 | Steindorf | 156/240 |
| 3,652,319 | 3/1972 | Amidon et al. . | |
| 3,824,099 | 7/1974 | Champ et al. . | |
| 3,839,032 | 10/1974 | Smith et al. . | |
| 3,847,642 | 11/1974 | Rhodes . | |
| 3,877,935 | 4/1975 | Regensburger . | |
| 4,216,252 | 8/1980 | Moeller | 427/38 |
| 4,216,283 | 8/1980 | Cooper et al. | 430/126 |
| 4,361,637 | 11/1982 | Stofko, Jr. et al. | 430/58 |
| 4,371,600 | 2/1983 | Schank et al. | 430/66 X |

FOREIGN PATENT DOCUMENTS

| | | | |
|---|---|---|---|
| 44-28037 | 11/1969 | Japan . | |
| 53-39131 | 4/1978 | Japan | 430/67 |
| 53-47835 | 4/1978 | Japan | 430/67 |
| 54-5731 | 1/1979 | Japan | 430/67 |
| 57-72151 | 5/1982 | Japan | 430/67 |

OTHER PUBLICATIONS

Harasta et al, "Radiated-Curable Overcoat Compositions and Toner Imaged Elements", Res. Discl., May 1983, pp. 188–190.

*Primary Examiner*—Roland E. Martin
*Attorney, Agent, or Firm*—Donald M. Sell; James A. Smith; David L. Weinstein

[57] ABSTRACT

A photoconductive assembly comprising a conductive substrate, a photoconductive layer and a topcoat comprised of a cured film-forming silicone polymer. The topcoat has a thickness of between 5 and 300 nm and a melting point above 100° C.

14 Claims, 2 Drawing Figures

SILICONE RELEASE COATINGS FOR EFFICIENT TONER TRANSFER

This is a continuation of application Ser. No. 520,208 filed Aug. 4, 1983, now abandoned.

BACKGROUND OF THE INVENTION

The invention relates to a photoconductive assembly which is capable of transferring developed toner images to a receptor.

Photographic microfilm, i.e. microfilm employing silver halide for image formation, is capable of providing resolution in the range of about 200 to 400 line pairs/mm. Although this degree of resolution is acceptable, microfiche prepared from photographic microfilm is impossible to update, i.e. add additional images at a date subsequent to development, because the development system results in destruction of the light-sensitivity of the microfiche.

Updatable microfiche comprises a photoconductive sheet, upon which sheet microimages are toner-developed by means of electrostatic processes. These photoconductive sheets suffer from two primary drawbacks: (1) they generally have a colored background, which results in poor contrast; (2) over time, the characteristics of the photoconductive sheet change, rendering it unacceptable for further updating.

Accordingly, it would be desirable to transfer microimages from the photoconductive sheet upon which they are developed by electrostatic processes to an inert microfiche sheet that would provide good contrast and not degrade over time, so that the microfiche would be updatable even after a long period of time, e.g., several years.

As is well-known in the art, the basic electrostatic process involves placing a uniform electrostatic charge on a photoconductive insulating layer, imagewise exposing the layer to dissipate the charge on the areas of the layer exposed to light, and developing the resulting electrostatic latent image with a material known as toner. The toner will normally be attracted to those areas of the layer which retain a charge, thereby forming a toner image corresponding to the electrostatic latent image. The toner image can then be transferred to a support surface such as a polymeric film. Toner can be either a powdered material comprising a blend of polymer and carbon or liquid material comprising an insulating liquid vehicle having finely divided solid material dispersed therein. Toner-developed microimages are preferably prepared with liquid toner developer, rather than powdered toner developer, because liquid toner developers are capable of giving higher resolution images with better gradation than powdered toner developers.

A problem that arises with the employment of liquid toner developers, however, is poor transfer from the photoconductor to the receptor, particularly when transfer is effected by heat, pressure, or a combination of heat and pressure. It is desirable to employ a combination of heat and pressure to effect transfer in order to improve gray scale fidelity. Poor transfer is manifested by (a) low transfer efficiency, e.g., below about 50 percent, and (b) low image resolution, e.g. less than about 80 line pairs/mm. Low transfer efficiency results in images that are light and/or speckled. Low image resolution results in images that are fuzzy.

Currently, the efficiency of toner transfer, when transfer is effected by means of heat and pressure, after any standard liquid development, generally cannot be raised to a high level, e.g. in excess of about 50 percent, without substantial loss in resolution. Furthermore, the level of resolution is generally limited to levels of up to 80 line pairs/mm.

SUMMARY OF THE INVENTION

This invention involves a photoconductive assembly comprising an electroconductive substrate, a photoconductive layer, and a topcoat comprised of a cured film-forming silicone polymer having a dry thickness from about 5 to about 300 nm. It has been discovered that by controlling the thickness of a silicone top coat on a photoconductive assembly within this range, up to 100% image transfer with a resolution in excess of 80 line pairs/mm, and frequently in excess of 200 line pairs/mm, can be provided. The melting point of the cured silicone polymer must be sufficiently high so that the silicone polymer will not liquify during image formation or image transfer. Liquification during image formation or transfer will result in blurred images. The invention also involves a process comprising the steps of exposing to a light pattern such a photoconductive assembly in its electrographically sensitized state, developing the image with a liquid toner developer, and transferring substantially all the toner image to a receptor surface while retaining high resolution. The photoconductive assembly and process of this invention can be used to provide microimages on microfiche by means of an electrostatic process.

DETAILED DESCRIPTION OF THE INVENTION

Figure 1:
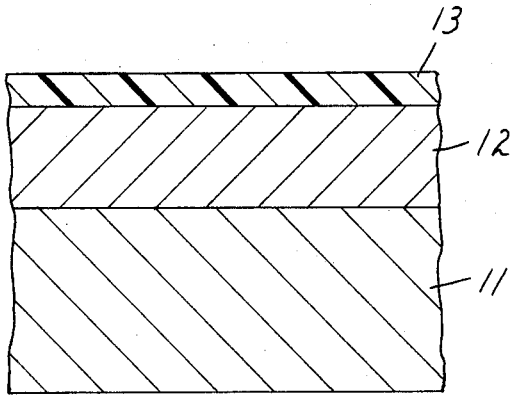
FIG. 1 represents an enlarged cross-section of one embodiment of the photoconductive assembly of the present invention.

The photoconductive assembly of the invention, shown in FIG. 1, comprises an electroconductive substrate 11, a photoconductive layer 12, and a topcoat 13 comprised of a film-forming silicone polymer.

Electroconductive substrates 11 for photoconductive systems are well known in the art and can be of two general classes: (a) self-supporting layers or blocks of conducting metals, or other highly conducting materials; (b) insulating materials, such as polymer sheets, glass, or paper, to which a thin conductive coating, e.g. vapor coated aluminum, has been applied.

The photoconductive layer 12 can be either (A) an organic photoconductor or (B) a dispersion of an inorganic photoconductor in particulate form dispersed in a suitable binder. The thickness of the photoconductive layer is dependent upon the material used, but is typically in the range 5 to 150 micrometers. The organic photoconductive layer can comprise a bilayer consisting of a charge generating layer comprising one material, such as a dyestuff or pigment, and a charge transport layer comprising another material, such as poly-N-vinylcarbazoles or derivatives of bis-(benzocarbazole)-phenylmethane in a suitable binder. A bilayer photoconductor suitable for this invention is described in U.S.

Pat. No. 4,361,637. Alternatively, the organic photoconductor can comprise only a single layer containing both the charge generating and charge transport materials, as described in U.S. Pat. No. 4,361,637.

Organic photoconductors such as phthalocyanine pigments and poly-N-vinylcarbazoles, with or without binders and additives that can extend their range of spectral sensitivity, are well known in the art. For example, U.S. Pat. No. 3,877,935 illustrates the use of polynuclear quinone pigments in a binder as a photoconductive layer. U.S. Pat. No. 3,824,099 demonstrates the use of squaric acid methine and tri-aryl pyrazoline compounds as an electrophotographic charge transport layer. The use of poly-N-vinylcarbazole as a photoconductive insulating layer is disclosed in U.S. Pat. No. 3,037,861. A number of diverse organic photoconductors have followed the development of the carbazole class of photoconductors such as quinones and anthrones (see, for example, Hayashi et al., *Bull. Chem. Soc. Japan*, vol. 39, (1966) pp. 1670–1673), but the carbazoles are still commonly used as photoconductors.

Inorganic photoconductors such as, for example, zinc oxide, titanium dioxide, cadmium sulfide, and antimony sulfide, dispersed in an insulating binder are well known in the art and may be used in any of their conventional versions with the addition of sensitizing dyes where required. Binders can be chosen from any of those not already containing silicone materials. The preferred binders are resinous materials, including, but not limited to, styrenebutadiene copolymers, modified acrylic polymers, vinyl acetate polymers, styrene-alkyd resins, soya-alkyl resins, polyvinylchloride, polyvinylidene chloride, acrylonitrile, polycarbonate, polyacrylic and methacrylic esters, polystyrene, polyesters, and combinations thereof.

Material for the topcoat 13 can be selected from the class of film-forming silicone polymers which are capable of further cross-linking by a curing action. A preferred class of these silicone polymers have structures which conform to the general formula

I

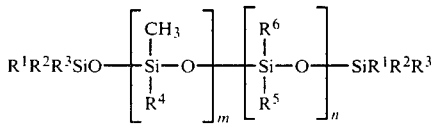

wherein $R^1$, $R^2$, and $R^3$ are independently selected from the group consisting of hydrogen, hydroxyl group, alkyl radical, substituted alkyl radical, cycloalkyl radical, aralkyl radical, aryl radical, and alkenyl radical, $R^4$, $R^5$ and $R^6$ are independently selected from the group consisting of alkyl radical, substituted alkyl radical, aryl radical, alkenyl radical, and epoxy radical, n and m are positive integers or zero, such that n+m is in the range from about 50 to about 15,000.

If $R^1$, $R^2$, $R^3$, $R^4$, $R^5$, or $R^6$ is an alkyl or substituted alkyl radical, it can contain from about 1 to about 20 carbon atoms, and preferably from about 1 to about 10 carbon atoms, such as methyl, ethyl, propyl, butyl, isobutyl, n-butyl, pentyl, isopentyl, hexyl, heptyl, octyl, decyl, pentadecyl, eicosyl, and the like. If $R^1$, $R^2$, $R^3$, $R^4$, $R^5$, or $R^6$ is a cycloalkyl radical, it preferably contains from 5 to about 8 carbon atoms in the ring, and preferably 5 to 6 carbon atoms in the ring, such as cyclopentyl, cyclohexyl. If $R^1$, $R^2$, $R^3$, $R^4$, $R^5$, or $R^6$ is an aralkyl radical, it preferably contains no more than a total of 20 carbon atoms, such as benzyl, ethyl phenyl. If $R^1$, $R^2$, $R^3$, $R^4$, $R^5$, or $R^6$ is an alkenyl radical it can contain from 2 to about 24 carbon atoms, and preferably from 2 to about 10 carbon atoms, such as ethenyl, propenyl, butenyl, pentenyl, hexenyl, heptenyl, octenyl, decenyl, pendadecenyl, eicosenyl, and the like. The aryl radicals include but are not limited to those containing from about 6 to about 20 carbon atoms, such as phenyl, naphthyl, anthryl, and the like. The aforementioned alkyl radicals can contain various different substituents including but not limited to halogen, such as chloride, bromide, fluoride, and iodide; alkyl, as defined herein, and the like. If $R^4$, $R^5$, or $R^6$ is an epoxy radical, it can contain up to 20 carbon atoms, and preferably up to 10 carbon atoms. The most preferred silicone polymers for the practice of this invention are those in which $R^4$, $R^5$, and $R^6$ are $—CH_3$. Particularly useful silicone polymers for this invention are those wherein $R^1$ is —OH, $R^2$, $R^3$, $R^4$, $R^5$, and $R^6$ are $—CH_3$, and n+m ranges from about 2000 to about 5000. Silicone polymers that are suitable for the present invention are described in U.S. Pat. Nos. 3,061,567 and 4,216,252, both of which are incorporated herein by reference. Commercially available silicone polymers that are suitable for the present invention include Syl-off® 23, Syl-off® 292, and Syl-off® 294 all of which are available from Dow Corning Corporation, and SS-4310, available from General Electric Company.

Crosslinking of these polymers by methods well known in the art gives resinous materials of high melting point, i.e. above about 100° C., or which do not melt, but decompose at high temperatures. Discussion of these types of compounds can be found in W. Noll, "Chemistry and Technology of Silicones", Academic Press, New York (1968). The resinous materials disclosed in Chapter 6, and, in particular, section 6.2 are the most useful materials for the present invention.

These silicone polymers can be dissolved in organic nonpolar solvents, such as xylene or heptane, to form solutions of low concentration, e.g. less than about 10 percent solids, which can then be applied onto the surface of the photoconductive layer by techniques well known in the art, for example, wire-wound rod, knife, extrusion, or gravure coating. Before coating, additives such as adhesion promoters, pot life extenders, cure accelerators, cross-linking agents, and catalysts can be added. Additives suitable for use with these polymers are well known in the art. For curable silicone polymers having the hydroxyl group as one or more of the substituent groups $R^1$, $R^2$, $R^3$, $R^4$, $R^5$ or $R^6$. Such additives can include, for example, Syl-off® 297 adhesion promoter/potlife extender, available from Dow Corning Corporation, having the general formula

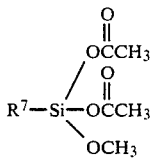

where $R^7$ is a long chain molecule ending in

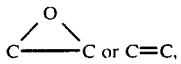

Dow Corning® C-4-2117 cure accelerator/cross-linking agent available from Dow Corning Corporation, having the general formula $$Si(O-CH_2CH_2-OCH_2CH_2-OCH_3)_4,$$

and Dow Corning® XY-176 catalyst, available from Dow Corning Corporation, having the general formula $$(C_4H_9)_2Sn(\overset{O}{\overset{\|}{O}}CCH_3)_2.$$

For curable silicone polymers having an alkenyl radical as one or more of the substituent groups $R^1$, $R^2$, $R^3$, $R^4$, $R^5$, or $R^6$, such additives can include, for example, cross-linking agents such as Dow Corning® DC-1107, available from Dow Corning Corporation, having the general formula

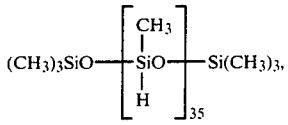

cure inhibitors such as dimethyl maleate, having the formula

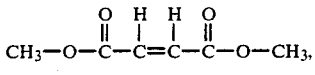

and catalysts such as platinum siloxane complexes, as described in U.S. Pat. No. 3,775,452.

The coating concentrations of the silicone polymers can be varied to give the desired coating weight on the photoconductive layer. Typically, concentrations in the range 0.01 to 5 percent by weight can be coated with a wire-wound rod (e.g., #4 Mayer bar, giving 9.1 micrometer wet thickness). Typical cure conditions are a few minutes, preferably about 2 to 10, at temperatures in the range 50° C. to 150° C. Room temperature curing is also possible, but the time of cure is much longer, e.g. 24 hours, under this condition.

Figure 2:
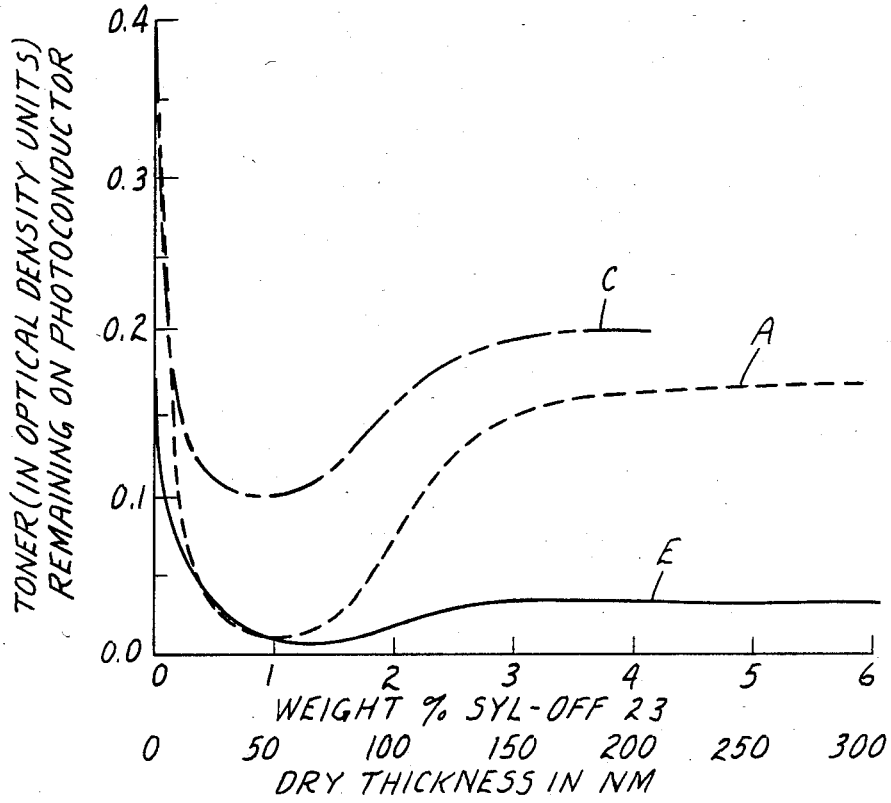
FIG. 2 is a typical graph of the optical density of remaining toner on the photoconductive assembly after the transfer process has been carried out, as a function of the thickness of the silicone topcoat.

The thickness of the dry coated layer of silicone polymer has been found to be critical for insuring good transfer characteristics of the liquid toner developed image. Very thin layers, with a lower useful limit of about 5 nm, are efficient in giving essentially complete transfer and unreduced definition of the image. At the higher end of the thickness range, values up to 400 nm can be used depending on the toner selected, but values in excess of 300 nm are generally not useful. FIG. 2 shows typical relationships of the optical density of a black toner remaining on the surface of the photoconductive assembly, after transfer to a receptor sheet, as a function of the thickness of the silicone topcoat. Percent toner transfer is inversely proportional to the optical density of toner remaining on the surface of the photoconductive assembly. Each of these curves shows an optimum in the transfer process at a silicone layer thickness of less than 150 nm, with serious loss in transfer efficiency at values above 200 nm and below 5 nm. The melting point of the cured silicone polymer is also important. The interface temperature between the photoconductive assembly and receptor surface is often at a level of about 100° C. or greater during the transfer process. The silicone polymer coating should not liquify during transfer, because liquification thereof will result in blurred or fuzzy images. Consequently, the cured silicone polymer should have a melting point above about 100° C.

The photoconductive assembly of this invention can be designed for use with a wide range of normal liquid toner developers which give high image resolution and good gradation, but which frequently suffer from serious difficulties in transferring the image from the surface of the photoconductive assembly to a receptor. Liquid toner developers can generally be characterized as a mixture of toner particles, e.g. electroscopic particles, in an electrically-insulating hydrophobic liquid carrier. The liquid toner developer can be flowed over a surface bearing an electrostatic image, or the image-bearing surface can be immersed in a tray of liquid toner developer. The toner developer can also be sprayed or rolled onto the surface bearing the electrostatic image. The particular method of applying the liquid toner developer to the image to be developed can vary. After toner development, the image is then dried, for example, by evaporation, blowing, and/or beating. When appropriate toner particles are dispersed in a properly selected liquid carrier, they acquire an electrophoretic charge of appropriate polarity. Greater detail concerning examples of various types of liquid toner developers can be obtained by reference to the following publications: U.S. Pat. Nos. 2,899,355; 2,907,674; 3,053,688; 3,058,914; 3,076,722; and 3,135,695. Generally, the liquid carrier has a low dielectric constant, e.g., less than about 3.0, and a resistivity greater than about $10^{10}$ ohm-cm. It can comprise a hydrocarbon or mixture of different hydrocarbons. These liquid carriers and mixtures of liquid carriers are exemplified by materials such as benzene, toluene, turpentine, carbon tetrachloride, mixed halide hydrocarbons, cyclopentane, cyclohexane, petroleum distillates, and mixtures thereof.

The toner particles admixed in the liquid carrier are finely-divided particles capable of carrying an electrostatic charge. Reference may be made to the literature noted hereinabove for details of the choice of materials for these particles. These toner particles, contain pigment or dye which may be prepared from numerous diverse organic and inorganic materials, such as, for example, talcum powder, aluminum bronze, carbon dust, gum copal, gum sandarac, carbonyl iron and iron oxides, especially magnetic iron particles, dyestuffs, and colored pigments. For optimum efficiency, it is desirable to employ a pigment in which a preponderance of the particles acquire a charge of one sign, either positive or negative. Listed below in Table I are a number of pigments which have a negative particle charge in liquid carrier and a number of pigments which acquire a positive particle charge in liquid carrier. Several pigments of each type are set forth in Table I. The carrier in which the charge was determined was cyclohexane.

TABLE I

| PIGMENT | MANUFACTURER |
|---|---|
| Negative Particle Pigments | |

TABLE I-continued

| PIGMENT | MANUFACTURER |
|---|---|
| Carbon Black G | Fisher Scientific Co. |
| Pyramide cerise toner R A 530 | Max Factor & Company |
| Fast mono green toner G - FG - 430 | General Dyestuff Company |
| Pigment yellow LX CyB 340 | Max Factor & Company |
| Solfast green 63100 | Sherwin-Williams Company |
| Positive Particle Pigments | |
| Aluminum power (flake) | |
| Antimony sulfide | |
| Cupric sulfide | |
| Carbonyliron | General Aniline & Film Corp. |
| Lamp black, Germantown | Columbian Carbon Co. |
| Mapico black | Columbian Carbon Co. |
| Nigrosine S.S.B. No. 5 | General Aniline & Film Corp. |
| Grassol black | Geigy Co., Inc. |
| Monastral fast blue B | E. I. duPont de Nemours & Co. |
| Dresden blue 81451 | Imperial Paper & Color Corp. |
| Pyramid germainium toner RA 500 E | Max Factor & Co. |
| Selkirk red X2028 | Imperial Paper & Color Corp. |
| Winthrop red X-166 | Imperial Paper & Color Corp. |
| Britone red MCP974 | Sherwin-Williams Co. |
| Britone red MCP1290 | Sherwin-Williams Co. |
| Duratint green 48-238 | Max Factor & Co. |
| C.P. light yellow X-1709 | Imperial Paper & Color Corp. |
| W81 benzidine yellow anilide | Sherwin-Williams Co. |

The particle size of the toner particles should generally be in the range of from about 0.1 to about 20.0 micrometers. Generally, toners having smaller particle size provide better resolution in the resultant prints. For example, where continuous tone copy is to be developed using liquid toner developers, it is desirable to use fairly small particle sizes, on the order of about 1 micrometer or less, to obtain optimum resolution. The toner particles can generally be admixed with the carrier liquid by some type of milling step or combined mixing and milling operation. Other additives can also be included in the developer, e.g. stablizers, binders, and driers. Ordinarily, the final developer composition can contain from about 0.01 to about 20 percent by weight toner particles and from about 60 to about 99 percent by weight carrier liquid.

Transfer from the photoconductive assembly to the receptor can be effected by either of two methods. Thermal transfer, which is carried out by bringing a preheated receptor in contact with the liquid toner developed photoconductive assembly, has been found to provide excellent transfer and fixing. The equipment for effecting this mode of transfer consists of an aluminum plate on one surface of which a poster board is affixed to insure an even application of pressure during transfer. The photoconductive assembly is then placed face up on the poster board and attached with pressure sensitive adhesive tape. The receptor is preheated with a heated hydraulic ram that can bring the photoconductive assembly and the receptor in contact at 500–3000 psi for 0.2–5 sec. Typically, the transfer experiments were run at 1000–2000 psi, 0.5–1.0 sec. contact time, and 85°–95° C. interface temperature (i.e., temperature between the photoconductive assembly and the receptor during transfer).

The second method that can be used for toner transfer and fixing is flash/pressure transfer. This method uses the same holder for the photoconductive assembly as was used in the thermal method, but without the poster board backing. The receptor station, which consists of a receptor resting on an elastic pad which rests on a thick glass plate, is connected to a hydraulic ram. Immediately under the glass plate there is a xenon flash unit. The transfer process involves bringing the imaged photoconductive assembly and receptor together at 1000–2000 psi and then exposing the composite to a 0.001 second xenon flash. The materials are then separated. In either method, the silicone polymer is partially or totally removed from the photoconductive assembly as a result of the transfer step.

A wide variety of sheet materials can be used as the receptor surface, such as, for example fabric, paper, glass, and various polymers. Of particular interest for high resolution images are macroscopically smooth and visually transparent plastic materials, such as polyamide, polyvinylchloride, polyvinylacetate, acrylic, melamine, polyvinylidenechloride (PVDC) primed polyester, polystyrene, and polyester.

The photoconductive assembly of the present invention is useful for high resolution electrostatic imaging processes. The resolution provided by the assembly and process of the present invention renders them particularly useful for preparing and updating microfiche. At present, updating of microfiche is commonly carried out by an electrostatic process on a photoconductive substrate, which substrate has a propensity toward degradation. The article and process of this invention allow updating of microfiche prepared on substrates that are much less susceptible to degradation than photoconductive substrates.

The following non-limiting examples illustrate the invention.

EXAMPLE 1

A coating solution was prepared by mixing the following ingredients in the amounts indicated:

| Ingredient | Amount |
|---|---|
| Heptane | 10 g |
| Vinyl functionalized polyorganosiloxane containing a platinum catalyst (SS-4310, General Electric Co.) | 0.05 g |
| Polyorganosiloxane cross-linking agent (SS-4300C, General Electric Co.) | 1 drop |

Coatings were applied with #6 Mayer bar to a wet thickness of 14 micrometers on a photoconductive material formulated from an aluminized polyester substrate coated with a mixture of 40 percent by weight bis-(N-ethyl-1,2-benzocarbazol-5-yl)phenylmethane and 60 percent by weight polyester binder (Vitel ® 207).

The coating was cured for 3 minutes at 107° C., giving a dry thickness of about 70 nm. The coated sample was then dark adapted for 24 hours, corona charged at 500 V, exposed through a step tablet, and developed with a liquid toner developer.

Liquid toner developer for development of the electrostatic image was formulated from the following ingredients in the amounts indicated:

| | Toner A | |
|---|---|---|
| Raw Material | Proportions by weight | Percent of composition by weight |
| Carbon black[a] | 2 | 10.5 |
| Polyethylene[b] | 1 | 5.3 |
| Succinimide[c] | 4 | 21.0 |
| Isoparaffinic | 12 | 63.2 |

-continued

| Raw Material | Toner A Proportions by weight | Percent of composition by weight |
|---|---|---|
| hydrocarbon[d] | | 100.0 |

[a]Tintacarb 300 Carbon Black, manufactured by Australian Carbon Black, Altona, Victoria, Australia
[b]Polyethylene AC-6, low molecular weight polyethylene, manufactured by Allied Chemicals, New York
[c]OLOA 1200, an oil soluble succinimide, manufactured by Chevron Chemical Company, San Francisco, California
[d]Isopar M, Isoparaffinic hydrocarbon, high boiling point, manufactured by Exxon Corp.

The developer components were mixed according to the following procedures:

1. The carbon black was weighed and added to a ball jar (2600 mL nominal capacity, internal diameter of 18 cm).
2. The remaining ingredients were weighed into a common container, preferably a glass beaker, and the mixture heated on a hotplate with stirring until a brown solution formed. A temperature of 110±10° C. was sufficient to melt the polyethylene.
3. The solution from (2) was allowed to cool slowly to ambient temperature, preferably around 20° C., in an undisturbed area. Upon cooling, a solid precipitated, and the cool brown slurry so formed was added to the ball jar.
4. The ball jar was sealed, and rotated at 70–75 rpm for 120 hours. The jar took a total charge of 475 g of raw materials, in the proportions previously shown.
5. Upon completion of the milling period, the jar was emptied and the contents placed in a container of suitable capacity to form the final toner concentrate.
6. The toner concentrate is diluted to form a liquid toner developer containing 1 part concentrate to 100 parts, by volume, carrier liquid (Isopar G, manufactured by Exxon Corp.)

The developed image was transferred to PVDC primed polyester by means of flash transfer. Optical density measurements on the photoconductive assembly and receptor sheets indicated 100% transfer of the image.

EXAMPLE 2

This example demonstrates the use of an epoxy siloxane as a coating for the photoconductive assembly. The same type of photoconductive assembly and the same coating conditions as in Example 1 were used. Two epoxy siloxanes having the following general structure

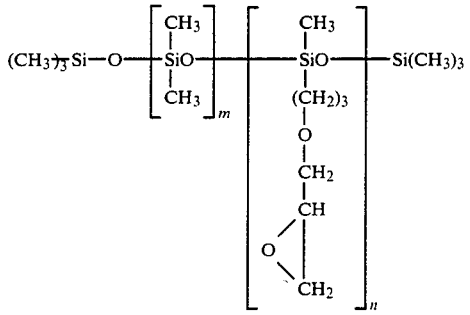

were used in heptane solution at a concentration of 0.5 percent by weight with an antimony-based catalyst. The two epoxy siloxanes differed in the values of n, m such that one exhibited molecular weight 35,000 with epoxy/siloxane ratio of 1/10, and the other exhibited molecular weight 13,000 with epoxy/siloxane ratio of 1/9.

The coatings were cured for 2 minutes at 93° C. (200° F.) giving a dry thickness of about 70 nm. After exposure, development, and transfer, under the same conditions as in Example 1, optical density readings indicated 100% image transfer.

EXAMPLE 3

In this example, and in Examples 4, 5 and 6, three silicone formulations were compared. The silicones were designated by the trademarks Syl-off®23, Syl-off®292, and Syl-off®294, all of which are commercially available from Dow Corning Corporation. Each was a silanol terminated dimethylsiloxane differing mainly in their number average molecular weights. All of these silicones are within the scope of Formula I. The details of their preparation for application by coating are as follows:

The silicone formulations, which are available from Dow Corning Corporation as 30–40 percent by weight solids in xylene, were diluted to 6 percent by weight solids with heptane. Syl-off®297 anchorage additive/-pot life extender (8 percent by weight based on silicone solids) was added to each solution and the resulting mixture was thoroughly mixed; Dow Corning®C-4-2117 cure accelerator (8 percent by weight based on silicone solids) was added to each solution and the resulting mixture was thoroughly mixed; finally Dow Corning®XY-176 catalyst (10 percent by weight based on silicone solids) was added to each solution and the resulting mixture was thoroughly mixed. The resulting solutions were used to prepare 3,2,1,0.75, 0.50, 0.25, 0.10, 0.075, and 0.050 percent by weight solutions of each of the three release coating materials by dilution with heptane. Because the resulting solutions had a shelf life of less than 12 hours, the photoconductive assembly samples were coated immediately after solution preparation. The photoconductive material was formulated from a mixture of (1) a polyester binder derived from terephthalic acid, ethylene glycol and 2,2-bis(4-hydroxyethoxyphenyl)propane, (2) a charge transport material comprising bis(4-diethylamino-2-methylphenyl)-phenylmethane, and (3) a spectral sensitizing dye absorbing at green and red wavelengths in combination with (4) a photographic supersensitizer. The coatings were applied with a #4 Mayer bar which gave a 9 micrometer wet coating thickness. The coatings were then either allowed to air cure at room temperature for 4 to 12 hours or the coatings were allowed to dry for 10 minutes and were then cured at 80° C. (176° F.) for 3 minutes.

The photoconductive assembly samples were exposed and liquid toner developed under the same conditions as in Example 1. The transfer of the developed images from the treated photoconductive assembly samples was effected by means of flash transfer at 2000 psi onto PVDC primed polyester.

Two methods of measuring release coating efficiency were used in evaluating the photoconductive assemblies. In the first method, optical density and resolution on the series of release coated photoconductive assembly samples were compared with those values from untreated samples. An acceptable result was defined as no decrease in $D_{max}$ and resolution. In the second method, the transfer efficiency upon flash transfer was actually measured. More consistent, and, consequently, more meaningful results were obtained by measuring the optical density remaining on the photoconductive assembly samples instead of calculating the actual percent transfer. The optical density remaining on the photoconductive assembly samples was less dependent on original optical density than was the percent transfer calculation. An optical density of 0.00 represented complete transfer of the image. In all cases transferred optical density ranged from 1.0 to 2.0, and resolution ranged from 150 lp/mm to 200 lp/mm.

The results derived from this example also indicated that no significant difference in transfer characteristics could be attributable to the method of curing the silicone polymer release coating. Two identical sets of samples of Syl-off®23 silicone polymer were compared, one set being cured in air for 24 hours at room temperature (20° C.), the other set being dried in air for 10 minutes and then cured at 80° C. (176° F.) for 3 minutes.

The samples were exposed and liquid toner developed as in Example 1, using Toner A as defined therein. The developed images were transferred from the samples to PVDC primed polyester by means of flash transfer at 2000 psi. The results are set forth below:

| Percent by weight Syl-off ® 23 in coating composition | Optical density on photoconductor after transfer (samples cured at 20° C.) | Optical density on photoconductor after transfer (samples cured at 80° C.) |
|---|---|---|
| 3.0 | 0.16 | 0.15 |
| 1.2 | 0.08 | 0.07 |
| 0.43 | 0.00 | 0.00 |
| 0.043 | 0.18 | 0.20 |
| 0.00 (uncoated photoconductor | 0.26 | 0.26 |

For the examples which follow, samples that were air cured at room temperature were used unless otherwise indicated. All optical density results reported herein were the average of 6 to 8 measurements on two different samples.

Dry thicknesses of the release coatings were estimated by calculation from the wet coating thickness of 9 micrometers and the weight percent concentration of the release agent, i.e. the cured silicone polymer. For example, percent by weight of 3.0 and 0.05 are equivalent to 270 nm and 4.5 nm, respectively. Generally, the thickness of the silicone polymer topcoat can be estimated from the formula:

$$t_s = (t_1 \times 1000)\left(\frac{w}{100}\right)\left(\frac{d_1}{d_s}\right) = 10(t_1)(w)\left(\frac{d_1}{d_s}\right)$$

where w = weight percent concentration of silicone in the coating solution $t_1$ = wet thickness of the coating as defined by the particular wire wound coating bar (μm)

$t_s$ = thickness of the dried silicone layer (nm)

$d_1$ = density of the solvent used (g/cm$^3$)

$d_s$ = density of the dried silicone layer (g/cm$^3$)

EXAMPLE 4

This example demonstrates the effect of concentration of Syl-off®297 on transfer efficiency. Three solutions containing Syl-off®23 (3 percent by weight) and varying amounts of Syl-off®297 were prepared. The amount of Syl-off®297 was varied from 8 to 24 percent by weight (based on silicone solids). The silicone polymer release layer was coated on the photoconductor and images were developed with Toner A from Example 1 and transferred to PVDC primed polyester as in Example 3. The results for each sample are presented below.

| Percent by weight Syl-off ® 297 anchorage agent | Optical density remaining after transfer |
|---|---|
| 8 | 0.20 |
| 16 | 0.18 |
| 24 | 0.17 |

The above results show that the amount of anchorage agent, Syl-off®297, does not have a significant effect on transfer efficiency of this toner to PVDC primed polyester.

EXAMPLE 5

This example demonstrates the effect of different liquid toner formulations. Testing procedures were identical to those in Example 2. The method of preparing the coatings and the testing procedures were the same as those of Example 3. Optical densities were those of the toner remaining on the photoconductive assembly sample after transfer.

TABLE II

| | Eastman Kodak Toner MX 1112 | | |
|---|---|---|---|
| Percent by weight silicone in coating composition | Optical density (Syl-off ® 23) | Optical density (Syl-off ® 292) | Optical density (Syl-off ® 294) |
| 6.0 | 0.00 | 0.00 | 0.00 |
| 3.0 | 0.00 | 0.00 | 0.00 |
| 2.0 | 0.00 | 0.00 | 0.00 |
| 1.0 | 0.00 | 0.00 | 0.00 |
| 0.75 | 0.00 | 0.00 | 0.00 |
| 0.50 | 0.00 | 0.00 | 0.00 |
| 0.25 | 0.00 | 0.00 | 0.00 |
| 0.10 | 0.00 | 0.00 | 0.00 |
| 0.075 | 0.00 | 0.00 | 0.00 |
| 0.050 | 0.00 | 0.00 | 0.00 |
| No Coating | 0.05 | | |

TABLE III

| | Toner B | | |
|---|---|---|---|
| Percent by weight silicone in coating composition | Optical density (Syl-off ® 23) | Optical density (Syl-off ® 292) | Optical density (Syl-off ® 294) |
| 6.0 | 0.63 | 0.38 | 0.39 |
| 3.0 | 0.74 | 0.37 | 0.24 |
| 2.0 | 0.40 | 0.19 | 0.35 |
| 1.0 | 0.25 | 0.07 | 0.32 |
| 0.75 | 0.22 | 0.18 | 0.39 |
| 0.50 | 0.25 | 0.07 | 0.45 |
| 0.25 | 0.67 | 0.18 | 0.47 |
| 0.10 | 0.61 | 0.64 | 0.69 |
| 0.075 | 0.71 | 0.80 | 0.67 |
| 0.050 | 0.67 | 0.66 | 0.68 |
| No Coating | 0.61 | | |

TABLE IV

| Percent by weight silicone in coating composition | Toner A Optical density (Syl-off ® 23) | Optical density (Syl-off ® 292) | Optical density (Syl-off ® 294) |
|---|---|---|---|
| 6.0 | 0.10 | 0.05 | 0.09 |
| 3.0 | 0.20 | 0.14 | 0.15 |
| 2.0 | 0.08 | 0.05 | 0.09 |
| 1.0 | 0.02 | 0.00 | 0.02 |
| 0.75 | 0.07 | 0.01 | 0.04 |
| 0.50 | 0.08 | 0.01 | 0.03 |
| 0.25 | 0.11 | 0.00 | 0.02 |
| 0.10 | 0.29 | 0.16 | 0.20 |
| 0.075 | 0.39 | 0.06 | 0.15 |
| 0.050 | 0.30 | 0.13 | 0.27 |
| No Coating | 0.39 | | |

TABLE V

| Percent by weight silicone in coating composition | Toner C Optical density (Syl-off ® 23) | Optical density (Syl-off ® 292) | Optical density (Syl-off ® 294) |
|---|---|---|---|
| 6.0 | 0.01 | 0.02 | 0.06 |
| 3.0 | 0.02 | 0.02 | 0.07 |
| 2.0 | 0.07 | 0.04 | 0.06 |
| 1.0 | 0.17 | 0.01 | 0.02 |
| 0.75 | 0.10 | 0.00 | 0.01 |
| 0.50 | 0.10 | 0.01 | 0.01 |
| 0.25 | 0.10 | 0.01 | 0.07 |
| 0.10 | 0.21 | 0.06 | 0.07 |
| 0.075 | 0.26 | 0.07 | 0.15 |
| 0.050 | 0.40 | 0.10 | 0.20 |
| No Coating | 0.39 | | |

TABLE VI

| Percent by weight silicone in coating composition | Toner D Optical density (Syl-off ® 23) | Optical density (Syl-off ® 292) | Optical density (Syl-off ® 294) |
|---|---|---|---|
| 6.0 | 0.01 | 0.00 | 0.01 |
| 3.0 | 0.00 | 0.00 | 0.00 |
| 2.0 | 0.00 | 0.00 | 0.00 |
| 1.0 | 0.00 | 0.00 | 0.00 |
| 0.75 | 0.00 | 0.00 | 0.00 |
| 0.50 | 0.00 | 0.00 | 0.00 |
| 0.25 | 0.00 | 0.01 | 0.01 |
| 0.10 | 0.00 | 0.01 | 0.01 |
| 0.075 | 0.00 | 0.01 | 0.01 |
| 0.050 | 0.02 | 0.01 | 0.01 |
| No Coating | 0.04 | | |

TABLE VII

| Percent by weight silicone in coating composition | Toner E Optical density (Syl-off ® 23) | Optical density (Syl-off ® 292) | Optical density (Syl-off ® 294) |
|---|---|---|---|
| 6.0 | 0.03 | 0.03 | 0.00 |
| 3.0 | 0.03 | 0.02 | 0.01 |
| 2.0 | 0.01 | 0.01 | 0.00 |
| 1.0 | 0.02 | 0.00 | 0.00 |
| 0.75 | 0.03 | 0.00 | 0.00 |
| 0.50 | 0.00 | 0.00 | 0.00 |
| 0.25 | 0.02 | 0.00 | 0.00 |
| 0.10 | 0.08 | 0.00 | 0.00 |
| 0.075 | 0.06 | 0.03 | 0.02 |
| 0.050 | 0.09 | 0.07 | 0.07 |

TABLE VII-continued

| Percent by weight silicone in coating composition | Toner E Optical density (Syl-off ® 23) | Optical density (Syl-off ® 292) | Optical density (Syl-off ® 294) |
|---|---|---|---|
| No Coating | 0.21 | | |

TABLE VIII

| Percent by weight silicone in coating composition | James River Toner C4B Optical density (Syl-off ® 23) | Optical density (Syl-off ® 292) | Optical density (Syl-off ® 294) |
|---|---|---|---|
| 6.0 | 0.30 | 0.01 | 0.13 |
| 3.0 | 0.15 | 0.05 | 0.06 |
| 2.0 | 0.03 | 0.00 | 0.07 |
| 1.0 | 0.06 | 0.00 | 0.02 |
| 0.75 | 0.07 | 0.01 | 0.01 |
| 0.50 | 0.07 | 0.00 | 0.05 |
| 0.10 | 0.15 | 0.14 | 0.42 |
| 0.075 | 0.16 | 0.12 | 0.92 |
| 0.050 | 0.18 | 0.26 | 0.74 |
| No Coating | 0.78 | | |

From the foregoing results, it can be seen that all three release coatings improved the transfer properties of the photoconductive assembly sample regardless of the toner tested. Optimum transfer occurred when the coatings were made from solutions containing from 0.25 to 1.0 percent by weight silicone polymer release agent. In the case of some toners, such as MX-1112, and Toner E, the optimum transfer occurred over a broader range, but the tendency for poor transfer at higher or lower coating thickness still remained. The results for three of the liquid toner developers, Toners A, C and E are illustrated in FIG. 2, in which optical density of the toner remaining on the photoconductive assembly sample after transfer is plotted against the coating concentration (and calculated dry thickness) of the silicone polymer layer prepared from Syl-off ®23.

The following table sets forth the compositions of the toners B, C, D, and E tested in Example 5.

TABLE IX

TONER FORMULATIONS

| | Parts by Weight B | C | D | E |
|---|---|---|---|---|
| Pigment | | | | |
| Tintacarb 300 | 50 | 20 | | |
| Microlith Green GT[a] | | 10 | | |
| Microlith Black CK[b] | | | 50 | |
| Philblack N220[c] | | | | 60 |
| Dispersant | 100 | 25 | 25 | 60 |
| OLOA 1200 | | | | |
| Resin | | | | |
| Polyethylene AC-6 | | | | 60 |
| Surcoprene 1000[d] | | 20 | 15 | |
| Plexol 909[e] | | 50 | 50 | |
| RJ-100[f] | | | | 30 |
| Carrier | | | | |
| Solvesso 100[g] | | 200 | 200 | |
| Isopar M | 300 | 600 | | 800 |

TABLE IX-continued

| TONER FORMULATIONS | Parts by Weight | | | |
|---|---|---|---|---|
| | B | C | D | E |
| Isopar G[h] | | | 500 | |

[a]Pigment resin mixture, manufactured by Ciba-Geigy.
[b]Carbon black resin mixture, manufactured by Ciba-Geigy.
[c]Carbon black, manufactured by Phillips Petroleum Company.
[d]Resin, manufactured by The Indestructible Paint Company, London, England.
[e]Resin, manufactured by Rohm and Haas.
[f]Hydroxylated polystyrene, manufactured by Monsanto Company.
[g]Petroleum solvent with a high aromatic content, manufactured by Exxon Corp.
[h]Isoparaffinic hydrocarbon, manufactured by Exxon Corp.

EXAMPLE 6

This example demonstrates the effects of three silicone polymer release agents, Syl-off®23, Syl-off®292, and Syl-off®294, on quality of the toned image before transfer is effected. Liquid Toner A was used and exposure and development was carried out under the same conditions as in Example 1. The photoconductive assembly samples tested were identical to those of Example 3. Resolution was determined by exposing a resolution bar chart onto the photoconductive assembly sample and reading visually the maximum resolved line pairs/mm (lp/mm) in the resulting toned image with a low power microscope. Toned densities for no exposure ($D_{max}$) and full exposure ($D_{min}$) were measured with a MacBeth densitometer. A full series of release agent coating thicknesses was prepared as in Example 3. The results are shown in Table IX.

TABLE X

| Percent by weight silicone in coating composition | Syl-off ® 23 | | | Syl-off ® 292 | | | Syl-off ® 294 | | |
|---|---|---|---|---|---|---|---|---|---|
| | Resolution (lp/mm) | $D_{max}$ | $D_{min}$ | Resolution (lp/mm) | $D_{max}$ | $D_{min}$ | Resolution (lp/mm) | $D_{max}$ | $D_{min}$ |
| 6.0 | 143 | 0.82 | 0.14 | 120 | 0.85 | 0.00 | 96 | 0.85 | 0.06 |
| 3.0 | 120 | 0.85 | 0.00 | 120 | 0.74 | 0.00 | 102 | 0.77 | 0.00 |
| 2.0 | 120 | 0.62 | 0.00 | 120 | 0.83 | 0.00 | 96 | 0.85 | 0.00 |
| 1.0 | 114 | 0.66 | 0.00 | 114 | 0.73 | 0.00 | 96 | 0.79 | 0.01 |
| 0.75 | 134 | 0.68 | 0.00 | 120 | 0.80 | 0.00 | 102 | 0.81 | 0.00 |
| 0.50 | 127 | 0.96 | 0.01 | 127 | 0.70 | 0.00 | 91 | 0.81 | 0.00 |
| 0.25 | 143 | 0.73 | 0.00 | 127 | 0.71 | 0.00 | 108 | 0.80 | 0.04 |
| 0.10 | 134 | 0.62 | 0.00 | 114 | 0.75 | 0.00 | 114 | 0.84 | 0.00 |
| 0.075 | 134 | 0.66 | 0.00 | 127 | 0.78 | 0.00 | 120 | 0.85 | 0.00 |
| 0.50 | 134 | 0.73 | 0.01 | 120 | 0.78 | 0.00 | 120 | 0.74 | 0.00 |
| No Coating | 127 | 0.63 | 0.00 | | | | | | |

Although thicker coatings of the release layers resulted in some loss in resolving power, there was no appreciable loss with thinner coatings. Furthermore, there was a substantial increase in the $D_{max}$ levels without any deterioration in the clarity of the $D_{min}$ areas.

EXAMPLE 7

This example demonstrates the effect of tack level of the dry silicone coatings on transfer efficiency and image resolution.

Three silicone polymers representing the tack range listed in U.S. Pat. No. 3,554,836 were chosen for coating onto a photoconductor. The photoconductor was formulated from a bis-(benzocarbazole)phenylmethane (as disclosed in Example 1) on an electro-conducting substrate of 100 m thick polyester vapor coated with a thin, opaque layer of aluminum. These silicones, marketed by General Electric as RTV 11, RTV 21, and RTV 630, were reported to have tack values of 82, 220 and 1220 g/cm$^2$, respectively. Slurries of these silicones in trichlorofluoromethane (Freon®11) were prepared by mixing the following ingredients in the amounts indicated:

| Ingredient | Amount | | |
|---|---|---|---|
| | Slurry A | Slurry B | Slurry C |
| Silicone polymer | | | |
| RTV 11 | 6.0 g | | |
| RTV 21 | | 6.0 g | |
| RTV 630 | | | 6.0 g |
| Catalyst Dibutyltin dilaurate | 0.03 g | 0.03 g | 0.6 g |
| Solvent Freon ® 11 | 100 g | 100 g | 100 g |

Slurries A, B, C, were diluted with additional Freon®11 to give a concentration series of solutions of 3, 1.0, 0.5, 0.25, 0.11 and 0.06 percent by weight concentration. The solution were applied to individual photoconductor samples using a #4 Mayer bar to give 9 micrometer wet thickness. These coatings were air dried and air cured for 72 hours.

The samples were exposed, liquid developed in toner E, and flash transferred to PVDC primed polyester. Resolutions of 100 lp/mm were typical in the transferred images.

Tack level results can be classed into three groups.

(a) those samples showing splitting of photoconductor (b) those samples showing partial transfer of the toner (c) those samples showing complete transfer of the toner.

TABLE XI

| Percent by weight silicone in coating composition | RTV 630 | | RTV 21 | | RTV 11 | |
|---|---|---|---|---|---|---|
| | Optical density on photoconductor | Optical density on receptor | Optical density on photoconductor | Optical density on receptor | Optical density on photoconductor | Optical density on receptor |
| 0.05 | S | | S | | S | |
| 0.05 | S | | S | | S | |
| 0.10 | S | | S | | S | |
| 0.10 | S | | S | | S | |
| 0.25 | S | | 0.03 | 1.02 | S | |

TABLE XI-continued

| Percent by weight silicone in coating composition | RTV 630 | | RTV 21 | | RTV 11 | |
|---|---|---|---|---|---|---|
| | Optical density on photoconductor | Optical density on receptor | Optical density on photoconductor | Optical density on receptor | Optical density on photoconductor | Optical density on receptor |
| 0.25 | S | | 0.04 | 1.13 | 0.08 | 0.08 |
| 0.50 | S | | 0.01 | 0.83 | 0.01 | 1.62 |
| 0.50 | S | | 0.00 | 1.56 | 0.05 | 0.76 |
| 1.0 | 0.34 | 0.63 | 0.01 | 0.01 | 0.00 | 1.32 |
| 1.0 | 0.26 | 0.49 | 0.01 | 0.89 | 0.00 | 1.28 |
| 3.0 | 0.20 | 0.92 | 0.00 | 1.15 | 0.02 | 1.15 |
| 3.0 | 0.20 | 0.00 | 0.00 | 0.62 | −0.01* | 1.25 |
| 6.0 | 0.02 | 1.42 | −0.03* | 1.27 | 0.00 | 1.68 |
| 6.0 | 0.01 | 1.10 | −0.03* | 1.12 | R | R |

S = split of photoconductor from photoconductor substrate during transfer to receptor.
R = image ruined prior to transfer.
*Negative value for optical density on photoconductor indicates that a small portion of the photoconductive layer itself was transferred.

TABLE XII

| Percent by weight silicone in coating composition | Optical Density of toner on fully exposed photoconductor | | |
|---|---|---|---|
| | RTV 630 | RTV 21 | RTV 11 |
| 0.05 | 0.40 | 0.44 | 0.41 |
| 0.10 | 0.42 | 0.44 | 0.39 |
| 0.25 | 0.41 | 0.38 | 0.37 |
| 0.50 | 0.41 | 0.41 | 0.42 |
| 1.0 | 0.41 | 0.44 | 0.38 |
| 3.0 | 0.44 | 0.43 | 0.38 |
| 6.0 | 0.43 | 0.48 | 0.43 |
| Untreated | 0.37 | 0.37 | 0.37 |

In all cases 100% transfer was achieved by using a sufficiently thick layer of the cured silicone polymer. Silicones having higher tack values were required to be applied in thicker layers in order to achieve equivalent transfer levels. Therefore, in general, low tack silicones are preferable for the present invention, because silicone layers of low thickness are required for high image resolution. Preferably, the tack value of the cured silicone polymer should be less than 300 g/cm$^2$.

It should be noted that the thickest layers of silicone in this example were about 0.5 micrometer dry thickness compared with thicknesses ranging from 6 to 1500 micrometers in U.S. Pat. No. 3,554,836.

Various modifications and alterations of this invention become apparent to those skilled in the art without departing in the spirit and scope of this invention, and it should be understood that this invention is not to be limited to the illustrative embodiments set forth herein.

What is claimed is:

1. A photoconductive assembly comprising an electroconductive substrate, a layer of photoconductive material, and a topcoat comprised of a cured silicone polymer having a dry thickness from 12.5 nm to 70 nm and which is capable of being formed by applying to the photoconductive layer at a wet coating thickness of 9 micrometers a solution comprising from 0.25 to 1.0 parts by weight of a curable silicone polymer in at least one organic non-polar solvent and drying said solution thereon to form said cured silicone top coat, which cured silicone top coat has a melting point above 100° C.

2. The assembly of claim 1 wherein the layer of photoconductive material comprises an organic photoconductor.

3. The assembly of claim 2 wherein the organic photoconductor is selected from the group consisting of poly-N-vinylcarbazole, bis-benzocarbazole methanes, oxydiazdes, phthalocyanine pigments, triarylmethanes, aromatic amines, hydrazones, and pyrazolines.

4. The assembly of claim 1 wherein the layer of photoconductive material comprises inorganic photoconductor dispersed in a binder.

5. The assembly of claim 1 wherein the cured silicone polymer is formed by cross-linking a cross-linkable silicone polymer having the formula

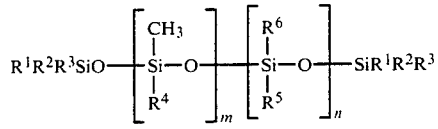

where $R^1$, $R^2$, $R^3$ are independently selected from the group consisting of hydrogen, hydroxyl group, alkyl radical, substituted alkyl radical, cycloalkyl radical, aralkyl radical, aryl radical, and alkenyl radical, $R^4$, $R^5$, $R^6$ are independently selected from the group consisting of alkyl radical, substituted alkyl radical, aryl radical, alkenyl radical, and epoxy radical, and n and m are positive integers or zero such that n+m is 50 to 15,000.

6. The assembly of claim 5 wherein the cross-linkable silicone polymer is a silanol-terminated dimethylsiloxane.

7. The assembly of claim 5 wherein the cross-linkable silicone polymer is a vinyl functional polydimethylsiloxane.

8. The assembly of claim 5 wherein the cross-linkable silicone polymer is a silanol-terminated epoxy siloxane.

9. The assembly of claim 1 wherein the tack value of the cured silicone polymer layer is less than 300 g/cm$^2$.

10. A process for producing a toner image copy comprising the steps of (1) imagewise exposing the sensitized photoconductive assembly of claim 1 to radiation, (2) developing said imagewise exposed assembly with a liquid toner, and (3) transferring the toned image to a receptor surface.

11. The process of claim 10 wherein the transfer step is effected by flash/pressure transfer.

12. The process of claim 10 wherein the transfer step is effected by thermal/pressure transfer.

13. The process of claim 10 wherein the transferred image exhibits a resolving power greater than 80 lp/mm.

14. A photoconductive assembly comprising an electroconductive substrate, a layer of photoconductive material, and a top coat comprised of a cured silicone polymer, which, when cured, has a dry thickness of from about 12.5 to about 50 nm, and has a melting point above 100° C.

* * * * *

UNITED STATES PATENT AND TRADEMARK OFFICE

CERTIFICATE OF CORRECTION

PATENT NO. : 4,600,673

DATED : July 15, 1986

INVENTOR(S) : William A. Hendrickson, Jack L. Evans, Kenneth R. Paulson and Robert W. Wilson It is certified that error appears in the above-identified patent and that said Letters Patent is hereby corrected as shown below:

Col. 6, line 29, "beating" should read --heating--.

Col. 15, line 31, "Table IX" should read --Table X--.

Col. 16, line 6, "100 m" should read --100 μm--.

Signed and Sealed this

Eleventh Day of November, 1986

*Attest:*

DONALD J. QUIGG

*Attesting Officer* *Commissioner of Patents and Trademarks*